US010161130B2

(12) United States Patent
Devlin et al.

(10) Patent No.: US 10,161,130 B2
(45) Date of Patent: Dec. 25, 2018

(54) PRE-FABRICATED, PORTABLE BUILDING WITH REMOVABLE ROOF ASSEMBLY

(71) Applicant: LITTELFUSE, INC., Chicago, IL (US)

(72) Inventors: Dwight Devlin, Alberta (CA); David Pain, Alberta (CA)

(73) Assignee: Littelfuse, Inc., Chicago, IL (US)

( * ) Notice: Subject to any disclaimer, the term of this patent is extended or adjusted under 35 U.S.C. 154(b) by 279 days.

(21) Appl. No.: 14/624,790

(22) Filed: Feb. 18, 2015

(65) Prior Publication Data

US 2016/0237676 A1 Aug. 18, 2016

(51) Int. Cl.
*E04B 7/02* (2006.01)
*E04H 1/12* (2006.01)

(52) U.S. Cl.
CPC ..... *E04B 7/026* (2013.01); *E04H 1/1205* (2013.01)

(58) Field of Classification Search
CPC ..... E04H 1/1205; E04B 7/026; E04B 7/022; E04B 7/024; E04B 2001/0053; E04B 7/04; E04B 7/16; E04B 7/163; E04B 7/166
USPC ..... 52/66, 90.1–93.2, 641, 645
See application file for complete search history.

(56) References Cited

U.S. PATENT DOCUMENTS 1,961,967 A * 6/1934 Goranson ..... E04G 1/28 182/186.6
6,418,683 B1 * 7/2002 Martensson ..... E04B 1/6129 403/364
6,519,900 B1 * 2/2003 Pierce ..... E04B 1/24 52/274
2009/0193725 A1 * 8/2009 Harrisson ..... E04B 1/3442 52/66
2014/0209410 A1 * 7/2014 Villar Cloquell ..... E06C 7/48 182/107

* cited by examiner

*Primary Examiner* — William V Gilbert

(57) ABSTRACT

A pre-fabricated, portable building comprises a structural support framework formed from interconnected beams defining an interior space therebetween. A floor panel on which the structural support framework is securely positioned. Connection assembly units are mounted to one or more sections of the structural support framework. A removable roof assembly is connected to each one of the connection assembly units on the structural support framework. The removable roof assembly is engineered to be installed or removed while maintaining a maximum height of the interior space without altering dimensions of the structural support framework.

10 Claims, 7 Drawing Sheets

PRE-FABRICATED, PORTABLE BUILDING WITH REMOVABLE ROOF ASSEMBLY

FIELD OF THE DISCLOSURE

The disclosure relates generally to the field of buildings and more particularly to a pre-fabricated, portable building with removable roof assembly.

BACKGROUND OF THE DISCLOSURE

Buildings, defined as structures for human habitation or use, are typically constructed at a building site. Certain types of buildings are designed to be transportable. Also, certain transportable buildings are often required to integrate industrial equipment, such as mechanical and electrical equipment, prior to shipping. For example, these transportable buildings need to integrate the mechanical and electrical equipment in a way that allows the majority of mechanical or electrical equipment to be pre-installed and tested in a controlled factory environment, and then transported in a cost effective manner to the remote locations and then put into service.

However, transportation limitations create significant challenges for transporting portable buildings between the fabrication location and a final installation location. For example, current industry practices transport large pieces of equipment, which should be pre-installed and tested in the transportable building prior to transport, on designated "high-load" corridors or by using other resource intensive transport solutions. As such, building designers are forced to reduce the size of a transportable building, such as height of the interior, to allow for buildings to be transported as a complete unit with the installed equipment.

Such practices have not proved suitable for addressing transportation limitations between the fabrication location and the final, remote installation location. To date, such transportable building designs have not proved suitable for higher quality assembly along with reduced transportation costs by conducting the fabrication of the portable building in an area with lower labor costs and proper tooling in a controlled environment.

SUMMARY

A need exists for pre-fabricated, portable building that includes tested mechanical and electrical equipment with a removable roof assembly engineered to be installed or removed prior to, or after, transportation while maintaining maximum design dimensions of a structural support framework of the pre-fabricated, portable building. It is with respect to these and other considerations that the present improvements have been needed.

Various embodiments are generally directed to a pre-fabricated, portable building comprising a structural support framework formed from interconnected beams defining an interior space therebetween. The pre-fabricated, portable building can include a floor panel on which the structural support framework is securely positioned. The pre-fabricated, portable building can include a connection assembly units mounted to one or more sections of the structural support framework, and a removable roof assembly connected to each one of the connection assembly units on the structural support framework. The removable roof assembly can be engineered to be installed and/or removed while maintaining a maximum height of the interior space without altering dimensions of the structural support framework.

Other embodiments of the pre-fabricated, portable building are described and claimed herein.

Various embodiments are generally directed to a modular, pre-fabricated portable building comprising a single structural support framework defining a rectangular cuboid box formed from interconnected steel members and defining an interior space therebetween. The structural support framework can have a top, a base, two opposed ends and two sides. The two sides can extend between the two opposed ends. Connection assembly units can be mounted to one or more sections of the top of the structural support framework. A removable roof assembly can have at least one hinge component, a first roof truss, and a second roof truss both connected to the hinge component configured to expand into a gable roof structure in an expanded form and retractable to form a single panel in a retracted form. The removable roof assembly can be connected to each one of the connection assembly units on the structural support framework. The removable roof assembly can be engineered to be installed and/or removed while maintaining a maximum height of the interior space without altering dimensions of the structural support framework. Other embodiments of the modular, pre-fabricated portable building are described and claimed herein.

Various embodiments are generally directed to method of manufacturing a pre-fabricated, portable building comprising providing a structural support framework formed from interconnected beams defining an interior space therebetween. The method of manufacturing can provide a floor panel on which the structural support framework is securely positioned. The method of manufacturing can provide connection assembly units mounted to one or more sections of the structural support framework. The method of manufacturing can provide a removable roof assembly connected to each one of the connection assembly units on the structural support framework, the removable roof assembly is engineered to be installed or removed while maintaining a maximum height of the interior space without altering dimensions of the structural support framework.

BRIEF DESCRIPTION OF THE DRAWINGS

By way of example, specific embodiments of the disclosed device will now be described, with reference to the accompanying drawings, in which.

DETAILED DESCRIPTION

Figure 1A:
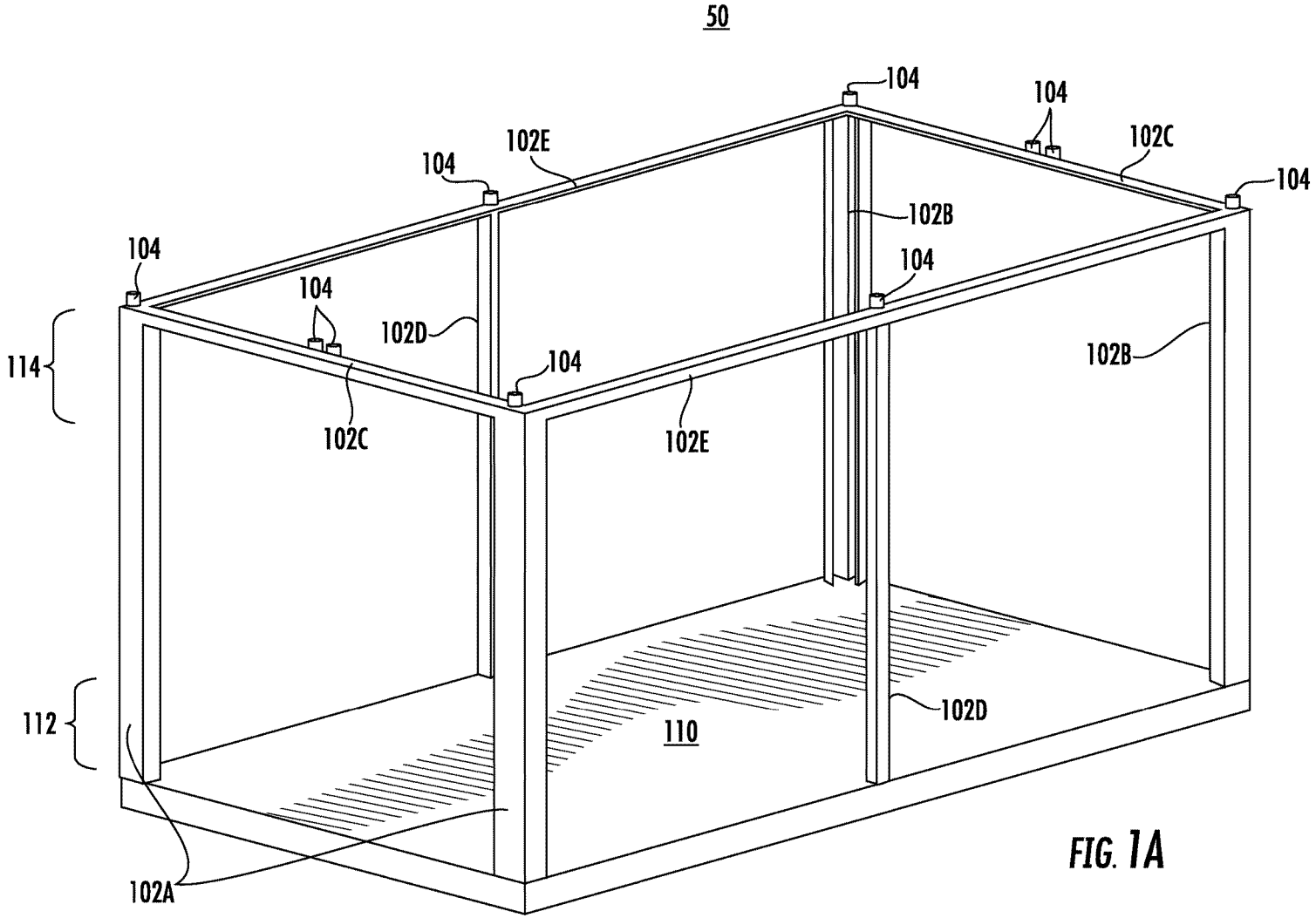
FIG. 1A illustrates a perspective view of an exemplary structural support framework of pre-fabricated portable building embodiment in accordance with the present disclosure.

The present disclosure will now be described more fully hereinafter with reference to the accompanying drawings, in which preferred embodiments of the disclosure are shown. This disclosure, however, may be embodied in many different forms and should not be construed as limited to the embodiments set forth herein. Rather, these embodiments are provided so that this disclosure will be thorough and complete, and will fully convey the scope of the disclosure to those skilled in the art. In the drawings, like numbers refer to like elements throughout.

Figure 1B:
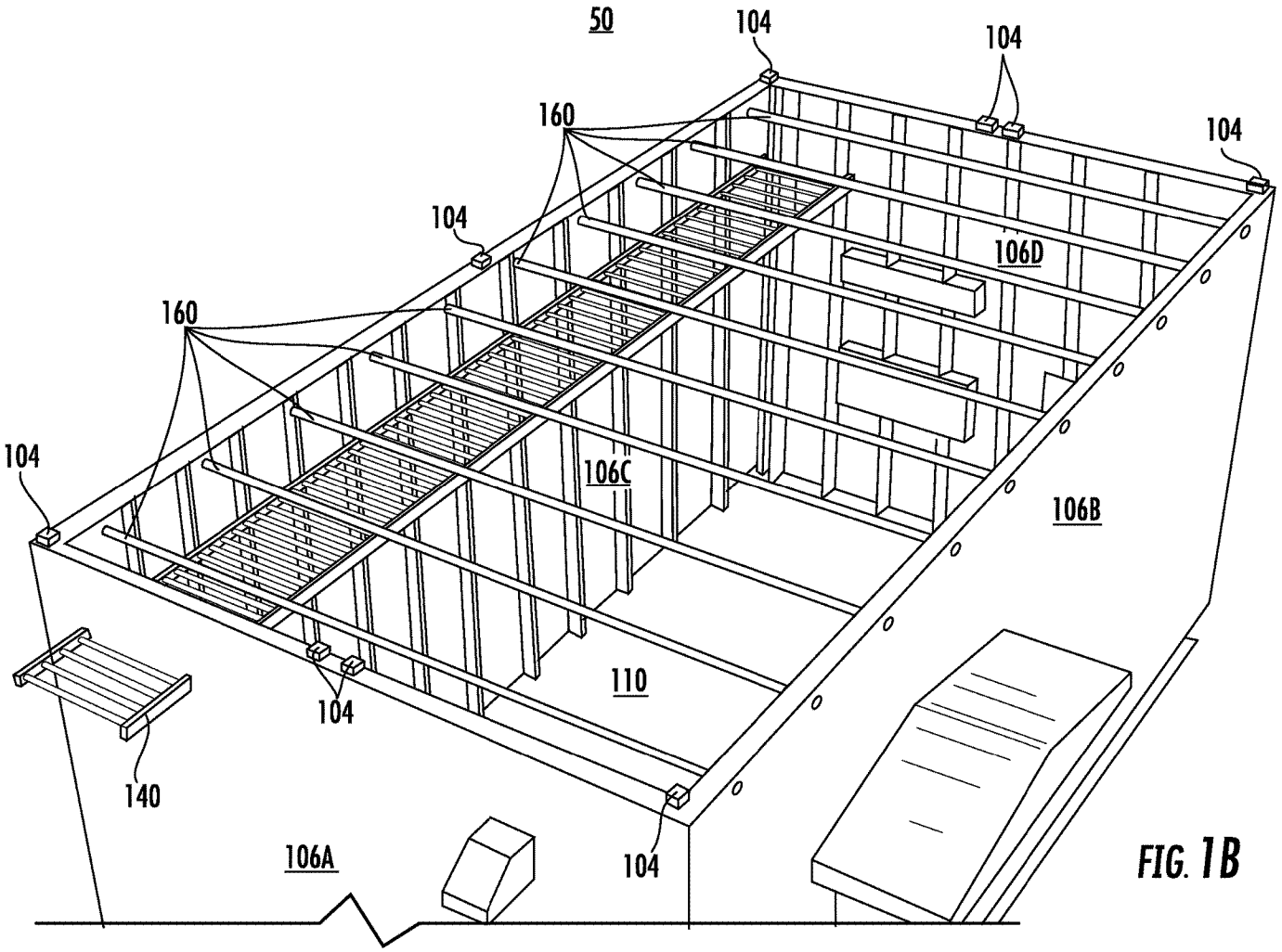
FIG. 1B illustrates a perspective cross-sectional top view of the structural support framework of FIG. 1A with wall panels and an adjustable walkway system of a pre-fabricated portable building embodiment in accordance with the present disclosure.

FIG. 1A illustrates a perspective view of an exemplary structural support framework 50 of a pre-fabricated portable building embodiment in accordance with the present disclosure. FIG. 1B also illustrates a perspective cross-sectional top view of structural support framework 50 of FIG. 1A with wall panels and an adjustable walkway system (e.g., a slidable walkway system) of a pre-fabricated portable building 100 embodiment in accordance with the present disclosure.

As illustrated in FIGS. 1A-1B, a structural support framework 50 can be provided for a pre-fabricated, portable building 100 (see FIGS. 4A-4B for a complete assembly) formed from interconnected beams 102 (illustrated in FIG. 1A as 102A-E), such as interconnected steel beams or steel tubing. The structural support framework 50 includes a top section 114 and a bottom section 112. The structural support framework 50 defines an interior space there between.

The structural support framework 50 can be one of variety of geometrical configurations that may be used, such as, for example, a rectangular shape, a circular shape, and/or a square shape. In one embodiment, the structural support framework 50 can be formed as a rectangular cuboid box from the interconnected beams 102A-E. However, the rectangular cuboid design of FIGS. 1-4A-B is for illustration purposes, and one or more variety types of designs may be implemented.

The interconnected beams 102A-E can be steel beams having a first end, which may be referred to as the top section 114, and a second end, which may be referred to as the bottom section 112. As shown in the rectangular cuboid box arrangement of the structural support framework 50, one or more of the interconnected beams 102A-E can be vertically positioned with the bottom section 112 that is connected to the floor panel 110. Also, one or more of the interconnected beams 102A-E can be horizontally positioned for connecting to the one or more of the interconnected beams 102A-E that are vertically positioned.

The structural support framework 50 can be a structural steel or aluminum frame and can allow one or more pre-fabricated, portable building 100 modules to be stacked on top of one another one of the structural support framework 50 of the pre-fabricated, portable building 100. The structural support framework 50 can be configured to secure one or more of the structural support framework 50 in and end-to-end, vertically stacked arrangement, and/or a side-by-side arrangement for creating multiple levels and additional space. For example, vertically stacking one or more pre-structural support framework 50, allows for additional pre-fabricated, portable buildings 100 to be used at a remote site, such as, for example, and industrial plant.

The structural strength and rigidity can be provided by the structural support framework 50 for a pre-fabricated, portable buildings, as described below, rather than the interlocking wall panels. The structural support framework 50 can minimize other costs involved with industrial plant expansions such as grading, driving support pilings, and/or pouring new concrete foundations. The modularity of the structural support framework 50 allows a standardized building design to be installed in a multitude of configurations by utilizing the same connections used to install the roof assembly.

The bottom section 112 of the structural support framework 50 can be positioned and disposed on a floor panel 110. In one embodiment, the floor panel 110 can be made of steel, or other material, welded onto or coupled onto a substructure. A series of one or more connection assembly units 104 may be mounted to one or more sections of the structural support framework 50. In one embodiment, the connection assembly units 104 can consists of steel eyes mounted on the structural support framework 50 and a removable roof assembly 200 (see FIG. 2), through which a pin is driven and retained with retention clips or cotter pins. In one embodiment, the one or more connection assembly units 104 may be mounted to one or more sections of the top section 114 of the interconnected beams 102.

One of a variety of types of wall panels 106, such as steel wall panels, can be provided. The wall panels 106 are illustrated collectively in FIG. 1B as 106A-D. The wall panels 106 can be arranged in one of a variety of designs, such as in a rectangular cuboid design. Each of the wall panels 106A-D can be configured with a locking mechanism for interlocking each of a variety of wall panels to each of the various of interconnected steel members. The wall panels 106 can be pre-fabricated. The wall panels 106A-D can be designed and pre-fabricated according to design preferences or according to transportation and job specific requirements. In one embodiment, the wall panels 106A-D can be bolted together with an overlap of metal. A sealant can be placed and/or spread in between the overlap created between each one of the wall panels 106A-D. The top and bottom of the wall panels 106A-D can be bolted to a skid and a rigid frame assembly of the pre-fabricated, portable building 100.

As illustrated in FIG. 1B, one or more cross beams 160 can be horizontally connected to the top section 114 of the interconnected beams 102A-E. More specifically, the cross beams 160 can be connected to both one or more of the interconnected beams 102A-D and one or more of the wall panels 106A-D. As illustrated in FIG. 1B, the cross beams 160 can be evenly spaced and horizontally connected to the wall panels 106C and 106B, which connect to the interconnected beams 102D and 102E, as shown in FIG. 1A. The structural support framework 50, the wall panels 106A-D, the cross beams 160, and the floor panel 110 form the rectangular cuboid box configuration. In one embodiment, the cross beams 160 can be configured to attach to the one or more of the interconnected beams 102A-D and/or one or more of the wall panels 106A-D via pre-fabricated holes bored into the one or more of the interconnected beams 102A-D and/or one or more of the wall panels 106A-D. In an alternative embodiment, the cross beams 160 can be configured with the connection assembly units 104 that are pre-fabricated and installed at one or more locations of the interconnected beams 102A-D and/or one or more of the wall panels 106A-D. In this way, the cross beams 160 may be quickly, and securely connected to the connection assembly units 104 that our pre-fabricated and installed to the one or more locations of the interconnected beams 102A-D and/or on one or more of the wall panels 106A-D.

A slidable walkway system 140 can be provided and can be adjustable between a stowed position (as shown in FIG. 1B) at the top section 114 of the structural support framework 50 and/or in a deployed position in which the slidable walkway system 140 connects the structural support framework 50 with a remote location from the structural support framework 50.

Figure 2:
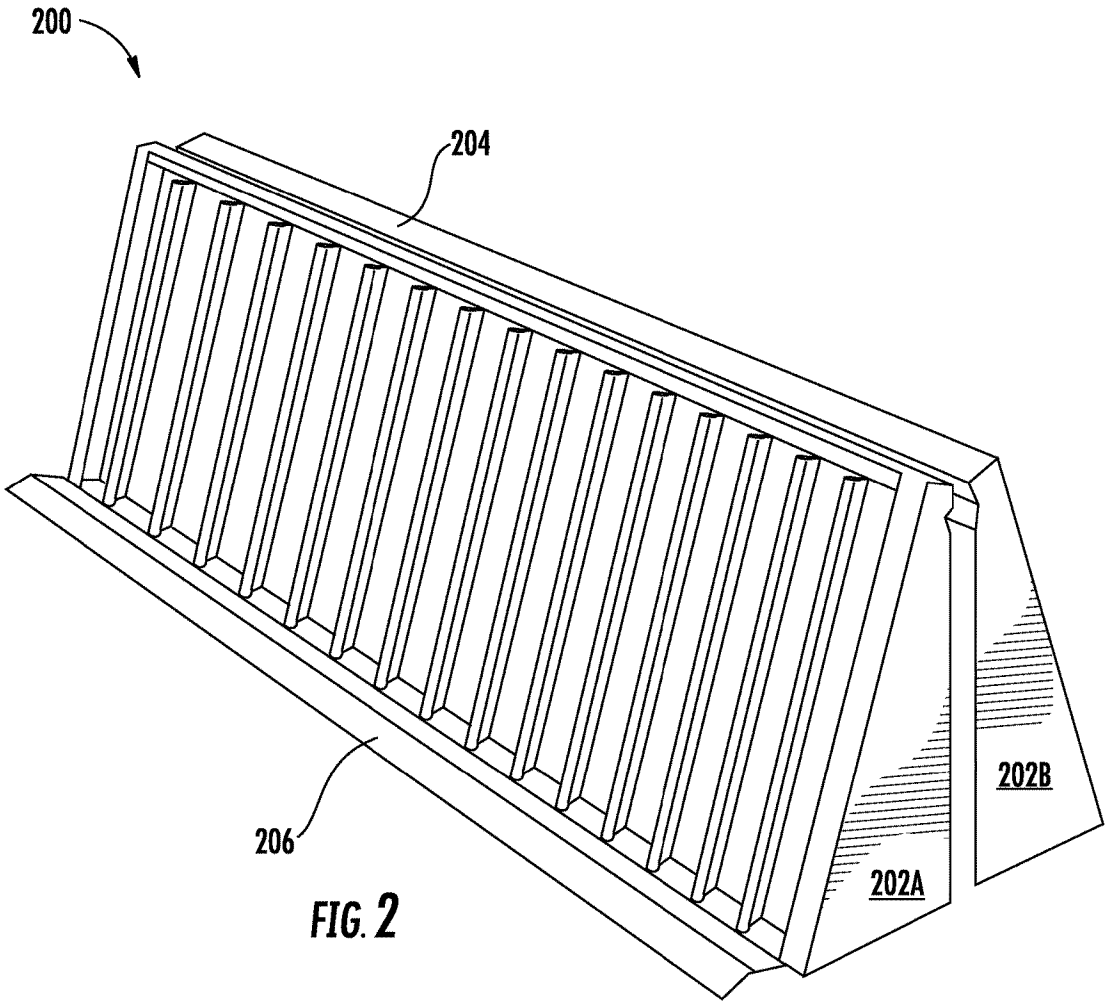
FIG. 2 illustrates a perspective view of a removable roof assembly embodiment in accordance with the present disclosure.

FIG. 2 illustrates a perspective view of a removable roof assembly 200 embodiment in accordance with the present disclosure. The removable roof assembly 200 connects to one or more of the connection assembly units 104 on the structural support framework 50. The removable roof assembly 200 can be engineered to provide a roof, ceiling, and/or an enclosure for the structural support framework 50. More specifically, the removable roof assembly 200 can be engineered enclose the top section 114 of the structural support framework 50. The removable roof assembly 200 may be installed onto or removed from the structural support framework 50 while maintaining a maximum height of the interior space without altering dimensions of the structural support framework 50.

The removable roof assembly 200 can be a gable roof top configuration or a single-slope roof top configuration. In one embodiment, the removable roof assembly 200 may include at least one hinge component 204, which may be one or more hinge components, and/or one continuous hinge traversing an entire length of one or more sides of the removable roof assembly 200. For example, the removable roof assembly 200 may include a first roof truss 202A a second roof truss 202B. The first roof truss 202A may be connected to the second roof truss 202B via the hinge component 204. The removable roof assembly 200 is configured to pivot or move via the hinge component 204 into an expanded form to form a gable roof structure. In an alternative embodiment, the removable roof assembly 200 can be configured to pivot and/or move via the hinge component 204 into a retracted form thereby forming into a single panel. In an additional embodiment, the removable roof assembly 200 can be configured to include only the first roof truss 202A without the hinge component 204 to form a single panel. In one embodiment, the removable roof assembly 200 may include the first roof truss 202A directly connected to the second roof truss 202B without the hinge component 204. In this manner, one side of the first roof truss 202A directly connects to one side of the second roof truss 202B. The first roof truss 202A can be angled away from the second roof truss 202B forming the gable roof structure.

Due to the versatility of the removable roof assembly 200, the structural support framework 50 may swap out and/or interchange the type of style and design configuration of the removable roof assembly 200 as needed or desired. For example, the pre-fabricated, portable building 100 may change from the gable roof top configuration into a single-slope roof top configuration at any time. Also, the removable roof assembly 200 can be easily swapped for other non-conventional roof type styles, such as, for example, alternating rooftops to adhere to certain requirements or restrictions required in urban installation.

In addition, having the ability of removing the removable roof assembly 200 provides additional benefits. For example, shipping the removable roof assembly 200 separately from the structural support framework 50, which can be assembled with the wall panels 106 and also a variety of tested, mechanical and electrical equipment, allows to separate the overall weight of the pre-fabricated, portable building 100 into several, smaller weight shipments. This reduces the cost, complexity, and permitting requirements of the transportation of the pre-fabricated, portable building 100 to the installation site. Further, since the final destination of the pre-fabricated, portable building 100 may be to remote locations with limited access, overcoming both weight restrictions and the ability to transport the equipment previously tested and installed in the pre-fabricated, portable building 100, provides the ability to deliver the pre-fabricated, portable building 100 when it is otherwise impossible. Since the removable roof assembly 200 is designed to be removed, maintenance operations on site may be expedited as equipment may now be lifted with a crane straight out of the top section 114 of the building instead of having to slide it through a side door.

Figure 3:
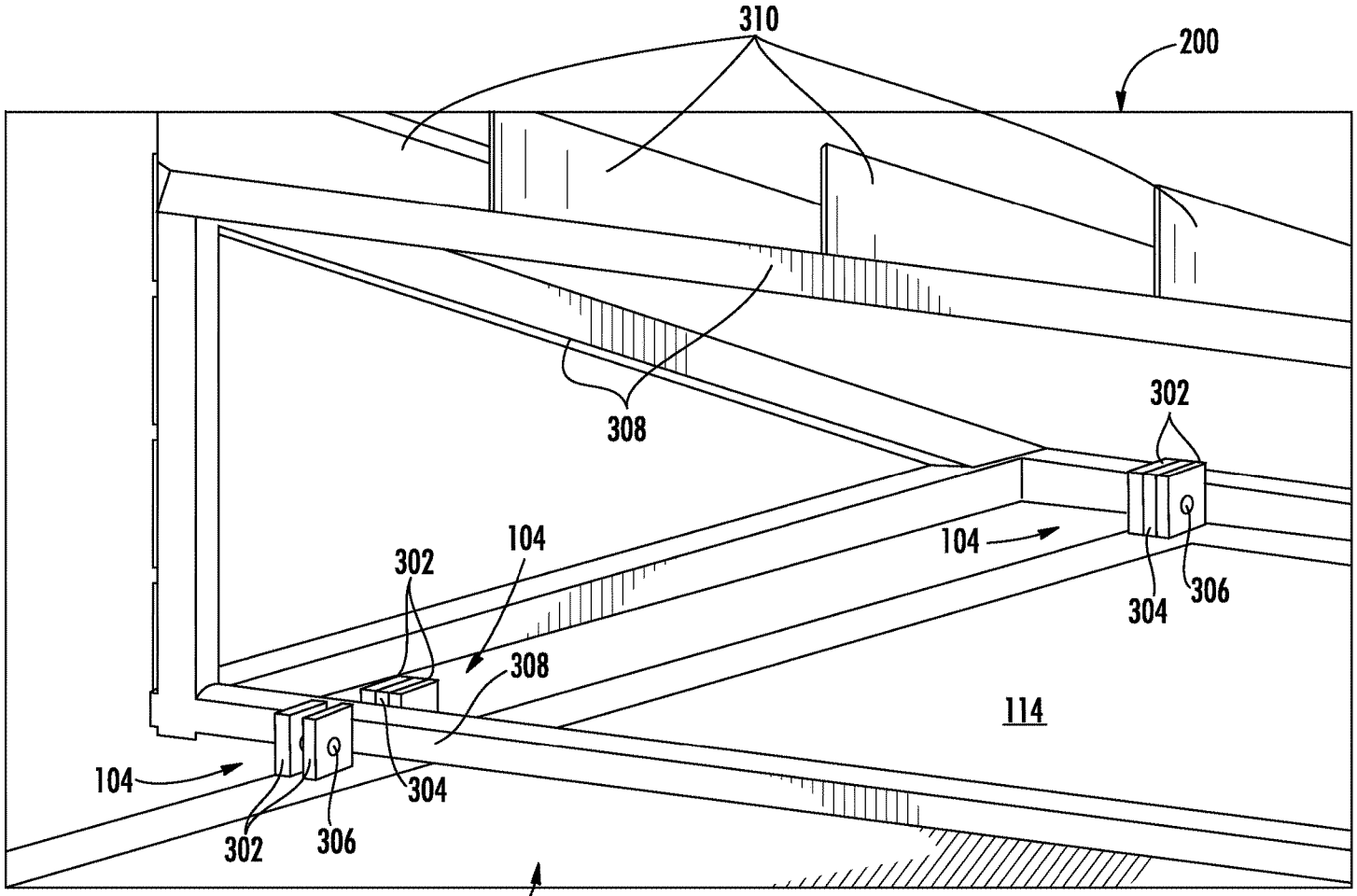
FIG. 3 illustrates a perspective view of connection assembly units connecting the structural support framework of FIG. 1A to the removable roof assembly depicted in FIG. 2.

FIG. 3 illustrates the connection assembly units 104 connecting the structural support framework 50 of FIG. 1A to the removable roof assembly 200 in FIG. 2. The removable roof assembly 200 can be configured to be connected to one or more of the connection assembly units 104 on the structural support framework 50. The removable roof assembly 200 can be engineered to enclose or seal the top section 114 of the structural support framework 50. The removable roof assembly 200 can be installed and/or removed while maintaining a maximum height of the interior space of a pre-fabricated portable building without altering dimensions of the structural support framework 50. The first roof truss 202A and/or the second roof truss 202B of the removable roof assembly 200 can include one or more structural beams 310, such as steel or aluminum beams, connected to one or more design support beams 308, which are inter connected forming one or more designs, shapes, and/or configurations of the removable roof assembly 200.

The connection assembly units 104 can include one or more extension plate 304 and at least two parallel plates 302 each having a central aperture 306 defined therein and vertically mounted to one or more sections the structural support framework 50, such as, one or more sections of the top section 114. The two parallel plates 302 are configured to receive one or more of the extension plates 304 mounted to one or more locations on the removable roof assembly 200 with the central aperture 306 also bored in the extension plates 304 (e.g., a central aperture 306 can be bored through both the two parallel plates 302 and the extension plates 304). The extension plates 304 can be aligned with the two parallel plates 302. That is, the extension plate 304 can be positioned between each of the two parallel plates 302 with the central aperture 306 in each of the two parallel plates 302 aligned with the central aperture 306 in the extension plate 304.

A retaining pin, such as a pin, screw, bolt, or other type of connecting device, can be inserted into the retaining aperture 304 and the two parallel plates 302 via the central aperture 306. Various connection points for mounting the connection assembly units 104 to the structural support framework 50 for connecting the structural support framework 50 with the removable roof assembly 200 may be predetermined according to the style of roof configuration and/or design process. FIG. 3 also illustrates the top section 114 having ceiling cover, which may be pre-installed. The ceiling cover may be rigid, semi-rigid, and/or a thin material configured to be automatically and/or mechanically retractable. The connection between the structural support framework 50 (which may be referred to as the building assembly) and the removable roof assembly 200 can be designed for assembly and configuration in the field using limited tools, without any prior training, and in inclement weather.

Figure 4A:
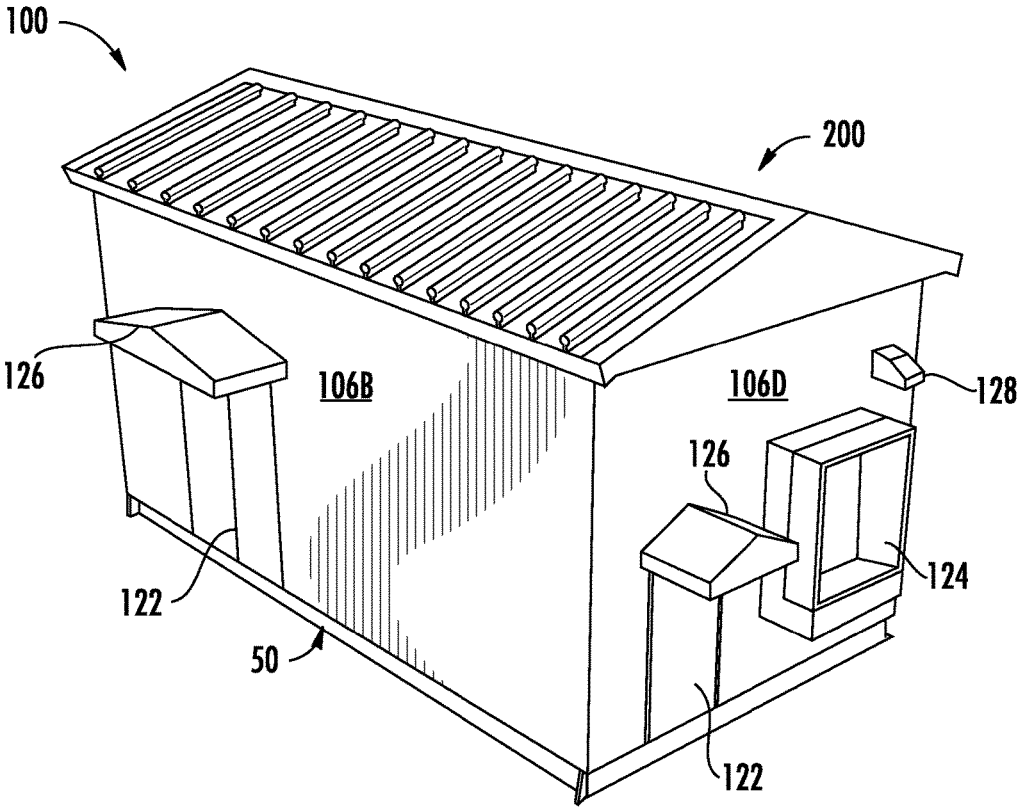
FIG. 4A illustrates a perspective view of a first geometrical configuration of the pre-fabricated portable building in accordance with FIGS. 1A-1B.
Figure 4B:
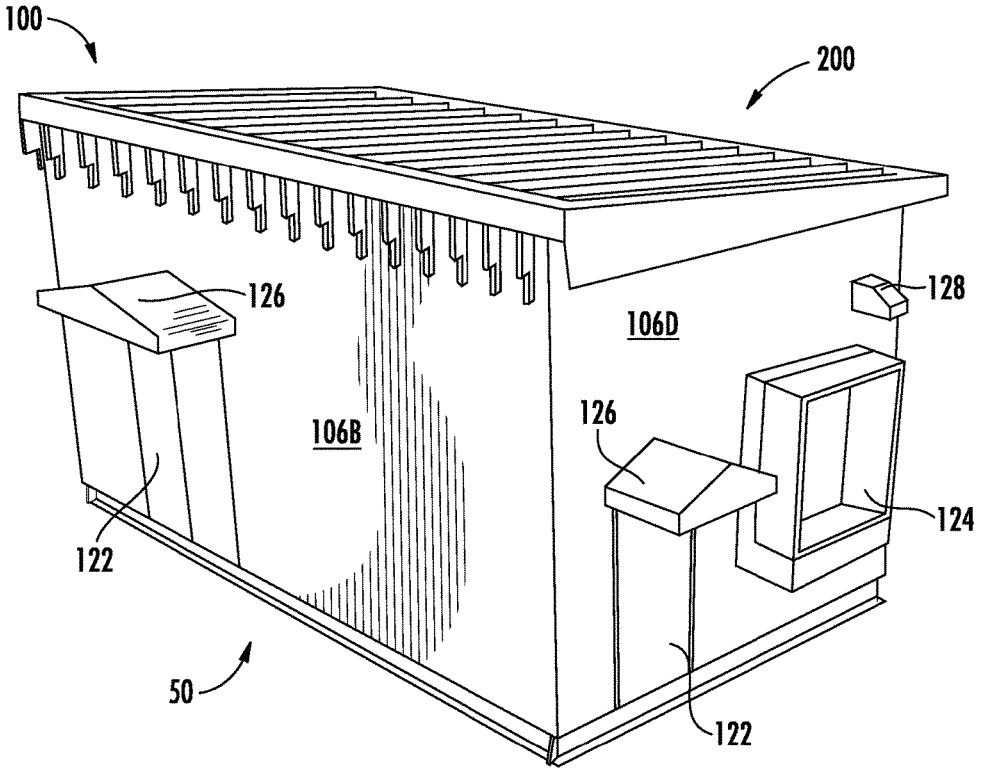
FIG. 4B illustrates a perspective view of a second geometrical configuration of the pre-fabricated portable building in accordance with FIGS. 1A-1B.

FIG. 4A-4B illustrates a perspective view of various geometrical configurations of the removable roof assembly 200 in FIG. 2 of a pre-fabricated portable building in accordance with FIGS. 1A-1B. The pre-fabricated, portable building 100 can illustrated in FIGS. 4A-4B in a complete assembly having the structural support framework 50 formed from interconnected beams 102. In one embodiment, the pre-fabricated, portable building 100 can be made from steel, aluminum, and/or a variety of hard, durable materials suitable for housing and integrating mechanical and electrical equipment. The removable roof assembly 200 can connects to each one of the connection assembly units 104 on the structural support framework 50. The removable roof assembly 200 can be engineered to provide a roof and enclose the structural support framework 50. The removable roof assembly 200 may be installed or removed while maintaining a maximum height of the interior space of the structural support framework 50 without altering dimensions of the structural support framework 50.

The wall panels 106B and 106C enclose and protect the interior space of the pre-fabricated, portable building 100. For, example, as depicted in FIG. 4A-4B wall panels 106B and 106C can include a variety of coverings, functional devices, and/or multiple pre-fabricated, installed, and tested mechanical and electrical components, which may be attached to or supported by the wall panels 106B and 106C. For example, the wall panels 106B and 106C can include a covering 126, such as an awning, a door system 122 for accessing the interior section of the pre-fabricated, portable building 100, and/or a variety of electrical/HVAC systems 124 (heating, ventilating, and air condition (HVAC).

Also, the slidable walkway system 140 (see FIG. 1B) can be included with the pre-fabricated, portable building 100 in a stowed position at the top (e.g., roof section) of the structural support framework and a deployed position in which the slidable walk-way system connects the structural support framework with a location remote from the structural support framework, the slidable walk-way system extending between the two opposed ends.

Figure 5:
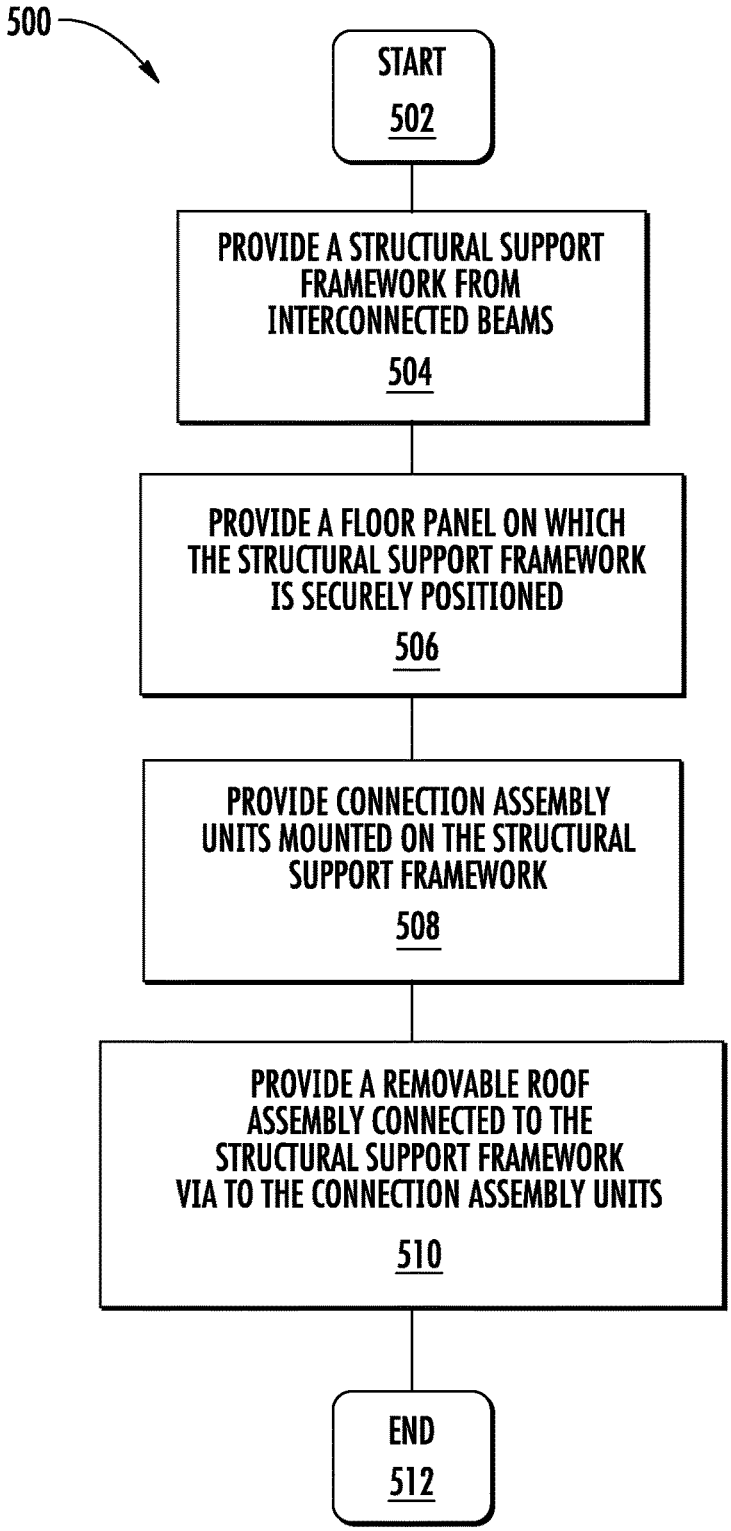
FIG. 5 illustrates a logic flow diagram in connection with the pre-fabricated portable building.

FIG. 5 illustrates a logic flow diagram in connection with the pre-fabricated portable building 100 shown in FIGS. 4A-B. FIG. 5 is a flow chart illustrating a method 500 for providing the pre-fabricated, portable building arranged in accordance with at least some embodiments of the present disclosure. In general, the method 500 is described with reference to FIGS. 1-4A-B. It is to be appreciated, that the method 500 may also be used to manufacture the pre-fabricated, portable building 100 as described herein or other pre-fabricated, portable buildings consistent with the present disclosure. The method 500 may begin at block 502. At block 504, a structural support framework 50 formed from interconnected beams 102A-E can be provided. The structural support framework 50 can include a top section 114 and a bottom section 112 and defines an interior space there between. At block 506, a floor panel 110 can be provided on which the bottom section 112 of the structural support framework 50 can be positioned. At block 506, connection assembly units 104, which can be mounted to one or more sections of the structural support framework 50, are provided. A removable roof assembly 200, connected to each one of the connection assembly units 104 on the structural support framework 50, can be provided at block 508. The removable roof assembly 200 can be engineered to enclose structural support framework, and can be installed and/or removed while maintaining a maximum height of the interior space without altering dimensions of the structural support framework. Also, the removable roof assembly can be designed and built separately from the other portions of the pre-fabricated, portable building 100, such as the structural support framework 50 having the wall panels 106, covering 126, a door system 122 and/or a variety of electrical/HVAC systems 124. The removable roof assembly 200 does not play a structural role so greater flexibility may be exercised in the shape and design of the pre-fabricated, portable building 100.

Various embodiments for a modular, pre-fabricated portable steel building are provided herein. In one embodiment, a single structural support framework defining a rectangular cuboid box formed from interconnected steel members with an interior space therebetween. The structural support framework can have a top, a base, two opposed ends and two sides, the two sides extending between the two opposed ends. The pre-fabricated portable steel building can include connection assembly units mounted to one or more sections of the structural support framework. The pre-fabricated portable steel building can include a removable roof assembly having at least one hinge component, a first roof truss and a second roof truss both connected to the hinge component configured to expand into a gable roof structure in an expanded form and retractable to form a single panel in a retracted form. The removable roof assembly can be connected to each one of the connection assembly units on the structural support framework. The removable roof assembly can be engineered and configured to be installed and/or removed while maintaining a maximum height of the interior space of the structural support framework without altering dimensions of the structural support framework.

The pre-fabricated portable steel building can include a floor panel on which the base of the structural support framework is secured. The pre-fabricated portable steel building can include wall panels each configured with a locking mechanism for interlocking each of the wall panels to each of the interconnected steel members. The wall panels can be pre-fabricated.

The wall panels can include one or more sides and at least one of the sides can be configured with a locking mechanism. The locking mechanism can be configured to allow the at least one of the sides to remain in a fixed position and/or an open position. The pre-fabricated portable steel building can include extension plates each having a retaining aperture defined therein. The extension plates can be mounted to one or more locations on the removable roof assembly.

The connection assembly units includes two parallel plates each having a central aperture therein and vertically mounted to the one or more sections of the top the structural support framework. The two parallel plates can be configured to receive one of the extension plates with the retaining aperture aligned with the central aperture. The pre-fabricated portable steel building can include a retaining pin configured to be urged through the central aperture and the retaining aperture. The pre-fabricated portable steel building can include a securing device configured to secure the retaining pin from being removed from the central aperture and the retaining aperture.

The interconnected steel members can be steel beams. The structural support framework can be configured to receive at least one alternative structural support framework for creating one or more levels and/or design configurations prior to securing the removable roof assembly. The alternative structural support framework can be configured with the connection assembly units mounted to one or more sections of the alternative structural support framework for connecting the structural support framework to the at least one alternative structural support framework.

The pre-fabricated portable steel building can include a slidable walk-way system adjustable between a stowed position at the top of the structural support framework and a deployed position in which the slidable walk-way system connects the structural support framework with a location remote from the structural support framework, the slidable walk-way system extending between the two opposed ends.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure has been disclosed with reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A pre-fabricated building comprising:

a structural support framework formed from a plurality of interconnected beams defining an interior space therebetween;

a floor panel on which the structural support framework is securely positioned;

connection assembly units mounted to one or more sections of the structural support framework;

a removable roof assembly connected to the connection assembly units on the structural support framework, the removable roof assembly configured to be installed or removed while allowing the structural support framework to maintain a maximum height of the interior space without altering dimensions of the structural support framework; and a slidable walk-way system that is adjustable, in an orientation parallel to the floor panel, between a stowed position, in which the slidable walk-way system is disposed within the interior space below cross beams in a top portion of the structural support framework and protruding from an aperture in the prefabricated building a first length, and a deployed position, in which the slidable walk-way system protrudes from the aperture a second length and connects the structural support framework with a location remote from the structural support framework, the second length greater than the first length.

2. The pre-fabricated building according to claim 1, further comprising a plurality of wall panels affixed to the plurality of interconnected beams.

3. The pre-fabricated building according to claim 2, wherein the plurality of wall panels are pre-fabricated.

4. The pre-fabricated building according to claim 1, wherein the connection assembly units includes:

two parallel plates each having a central aperture therein and vertically mounted to the one or more sections of the top portion of the structural support framework, the two parallel plates configured to receive one of a plurality of extension plates with a retaining aperture aligned with the central aperture, a retaining pin configured to be urged through the central aperture and the retaining aperture, and a retention clip configured to secure the retaining pin from being removed from the central aperture and the retaining aperture.

5. The pre-fabricated building according to claim 1, wherein the removable roof assembly includes a plurality of extension plates each having a retaining aperture defined therein, the plurality of extension plates mounted to one or more locations on the removable roof assembly.

6. The pre-fabricated building according to claim 1, wherein the removable roof assembly is a gable roof top configuration or a single-slope roof top configuration.

7. The pre-fabricated building according to claim 1, wherein the structural support framework is one of a plurality of geometrical configurations, the plurality of geometrical configurations including at least a rectangular shape, a circular shape, and a square shape.

8. The pre-fabricated building according to claim 1, wherein the structural support framework formed from the plurality of interconnected beams is a rectangular cuboid box, the plurality of interconnected beams are steel beams having a first end and a second end, the rectangular cuboid box comprising:

the plurality of interconnected beams vertically positioned with the first end connected to the floor panel; and a plurality of cross beams horizontally connecting to the second end of each of the plurality of interconnected beams, the plurality of interconnected beams and the plurality of cross beams along with the floor panel forming the rectangular cuboid box.

9. The pre-fabricated building according to claim 1, wherein the structural support framework is configured to stack at least one alternative structural support framework for creating a plurality of levels prior to securing the removable roof assembly.

10. A method of manufacturing a pre-fabricated building comprising:

providing a structural support framework formed from a plurality of interconnected beams defining an interior space therebetween;

providing a floor panel on which the structural support framework is securely positioned;

providing connection assembly units mounted to one or more sections of the structural support framework;

providing a removable roof assembly connected to the connection assembly units on the structural support framework, the removable roof assembly is engineered to be installed or removed while maintaining a maximum height of the interior space of the structural support framework without altering dimensions of the structural support framework; and providing a slidable walk-way system that is adjustable, in an orientation parallel to the floor panel, between a stowed position, in which the slidable walk-way system is disposed within the interior space below cross beams in a top portion of the structural support framework and protruding from an aperture in the prefabricated building a first length, and a deployed position, in which the slidable walk-way system protrudes from the aperture a second length and connects the structural support framework with a location remote from the structural support framework, the second length greater than the first length.

* * * * *